US006078776A

United States Patent [19]

Okamoto et al.

[11] Patent Number: 6,078,776

[45] Date of Patent: Jun. 20, 2000

[54] IMAGE FORMATION APPARATUS HAVING A PEELING CLAW AND HEATED ROLLERS

[75] Inventors: Masaya Okamoto; Isao Kubota, both of Niigata, Japan

[73] Assignee: NEC Corporation, Japan

[21] Appl. No.: 09/300,943

[22] Filed: Apr. 28, 1999

[30] Foreign Application Priority Data

| | | | |
|---|---|---|---|
| Apr. 30, 1998 | [JP] | Japan | 10-120242 |
| May 7, 1998 | [JP] | Japan | 10-124594 |
| Jun. 12, 1998 | [JP] | Japan | 10-165113 |

[51] Int. Cl.[7] ..... G03G 15/16; H05B 1/00

[52] U.S. Cl. ..... 399/308; 219/216

[58] Field of Search ..... 219/216; 399/121, 399/302, 307, 308, 323, 333, 398, 399

[56] References Cited

U.S. PATENT DOCUMENTS

| | | | |
|---|---|---|---|
| 4,531,825 | 7/1985 | Miwa et al. | 399/308 |
| 4,607,947 | 8/1986 | Ensing et al. | 399/308 |
| 5,200,285 | 4/1993 | Carrish | 430/45 |
| 5,428,430 | 6/1995 | Aslam et al. | 399/307 |

FOREIGN PATENT DOCUMENTS

| | | |
|---|---|---|
| 49-70632 | 7/1974 | Japan . |
| 51-122451 | 10/1976 | Japan . |
| 54-28368 | 3/1979 | Japan . |
| 5890645 | 5/1983 | Japan . |
| 6334573 | 2/1988 | Japan . |
| 5-107795 | 4/1993 | Japan . |
| 6242658 | 9/1994 | Japan . |
| 7049622 | 2/1995 | Japan . |
| 7049623 | 2/1995 | Japan . |
| 7064416 | 3/1995 | Japan . |
| 9269677 | 10/1997 | Japan . |
| 9314887 | 12/1997 | Japan . |

OTHER PUBLICATIONS

Japanese Office Action issued Jul. 6, 1999 in connection with a related application.

Japanese Office Action issued in a related Japanese Application.

*Primary Examiner*—Matthew S. Smith
*Assistant Examiner*—Hoang Ngo
*Attorney, Agent, or Firm*—Ostrolenk, Faber, Gerb & Soffen, LLP

[57] ABSTRACT

The present invention provides an image formation apparatus including: a belt-shaped photosensitive body; an electric charger for charging the photosensitive body; an exposure device for forming an electrostatic latent image on the photosensitive body; a developing device for forming a visible image according to the electrostatic latent image; a toner supply device for supplying to the developing device a toner used for forming the visible image; an intermediate transfer roller for transferring the visible image from the photosensitive body onto a recording medium; a fixing roller for fixing the visible image which has been transferred from the intermediate transfer roller onto the recording medium; a claw member for assisting peeling off of the recording medium from the intermediate transfer roller; and a heating roller arranged so as to be in contact with a point on a non-toner side of the intermediate transfer roller, wherein the claw member is arranged so as to surround the heating roller and has a claw portion which is in contact with an outer circumference of the intermediate transfer roller in the vicinity of a contact point between the intermediate transfer roller and the recording medium.

13 Claims, 8 Drawing Sheets

(A)

(B)

(A)

(B)

IMAGE FORMATION APPARATUS HAVING A PEELING CLAW AND HEATED ROLLERS

BACKGROUND OF THE INVENTION

1. Field of the Invention

The present invention relates to an image formation apparatus and in particular, to an image formation apparatus having an intermediate transfer roller.

2. Description of the Related Art

In general, in an image formation apparatus, an electrostatic latent image formed on a photosensitive body by an electro-photographic process is developed using toner so as to form a toner image. In an image formation apparatus having an intermediate transfer roller, this toner image is temporarily carried by the intermediate transfer roller and then transferred and fixed onto a recording medium to form an image.

That is, in the image formation apparatus in which a visible image is temporarily transferred from the photosensitive body onto the intermediate transfer roller, in order obtain a high quality image formation, it is necessary to preferably perform this transfer from the photosensitive body onto the intermediate transfer roller.

This requires that the intermediate transfer roller maintain a predetermined surface temperature.

There is a conventional technique for providing a built-in heating source in the intermediate transfer roller. However, the intermediate transfer roller is normally covered with resin layer such as a rubber layer and it is difficult to maintain its surface at a predetermined temperature only with the built-in heating source in the intermediate transfer roller. Moreover, it takes a considerable time to increase the surface temperature to the predetermined temperature. Accordingly, such an image formation apparatus shows a slow operation rise, requiring considerable power consumption, and the image quality is not stable.

In order to solve these problems, Japanese Patent Publication A-7-64416 [1] discloses a heating-fixing device for utilizing heat dissipation caused by a resistor-provided fixation film formed as an endless belt and fed along a power supply roller.

This technique enables to maintain at a predetermined value the surface temperature of the pressurizing roller and to reduce the power consumption because only a part of the resistor-provided fixation film is made to dissipate heat.

Moreover, Japanese Patent Publication A-7-49622 [2] discloses an electro-photographic printer comprising transfer-fixation means including two heat rollers, a tension roller, a heated endless belt, and a pressing mechanism. In connection with this, Japanese Patent Publication A-7-49623 [3] discloses an electro-photographic printer comprising transfer-fixation means having auxiliary heating means. Such configurations disclosed in [1] and [2] improve the heating efficiency and maintain the surface temperature of the heating roll at a sufficient temperature for transfer and fixation of a toner image. Note that the disclosures in [1] and [2] relate to a printer using a drum-shaped photosensitive body.

However, there is a problem that the heating-fixing device needs to have a space for feeding the resistor-provided fixation film. This prevents reduction in the apparatus size.

Moreover, in order to obtain a uniform heat application to the surface of the intermediate transfer roller, the heating means requires considerable power consumption.

Furthermore, when a belt-shaped photosensitive body is employed, the surface temperature of the intermediate transfer roller is significantly lowered after operation is started. This is because, heat is radiated from both sides of the belt-shaped photosensitive body and the photosensitive body having a lowered temperature is brought into contact with the transfer assisting roller or the intermediate transfer roller to deprive them of heat. As a result, the surface temperature of the intermediate transfer roller is lowered.

SUMMARY OF THE INVENTION

It is therefore an object of the present invention to provide an image formation apparatus of a small size and power saving type and capable of maintaining a predetermined print image quality. The image formation apparatus comprises a heating roller as a heat source for heating the surface of the intermediate transfer roller, so that the heating roller in combination with a claw member effectively compensate the heat loss from the intermediate transfer roller, thus enabling to maintain the surface temperature of the intermediate transfer roller at a predetermined temperature.

Another object of the present invention is to provide an image formation apparatus capable of eliminating an affect of the belt-shaped photosensitive body to the surface temperature of the intermediate transfer roller, so that the surface temperature of the intermediate transfer roller is maintained at a predetermined value, enabling to maintain a predetermined printing quality.

Still another object of the present invention is to provide an image formation apparatus of a small size and energy saving type comprising an arrangement of an intermediate transfer roller, a transfer assisting roller having a surface covered with a resin layer, and a fixing roller. When transfer is performed onto the intermediate transfer roller, a sufficient strength is applied to push against the photosensitive body so as to prevent useless heat radiation from the intermediate transfer roller, thus enabling to maintain a predetermined temperature and a predetermined printing quality.

The image formation apparatus according to the present invention comprises: a belt-shaped photosensitive body; an electric charger for charging the photosensitive body; an exposure device for forming an electrostatic latent image on the photosensitive body; a developing device for forming a visible image according to the electrostatic latent image; a toner supply device for supplying to the developing device a toner used for forming the visible image; an intermediate transfer roller for transferring the visible image from the photosensitive body onto a recording medium; a fixing roller for fixing the visible image which has been transferred from the intermediate transfer roller onto the recording medium; a claw member for assisting peeling off of the recording medium from the intermediate transfer roller; and a heating roller arranged so as to be in contact with a point on a non-toner side of the intermediate transfer roller.

The claw member is arranged so as to surround the heating roller and has a claw portion which is in contact with an outer circumference of the intermediate transfer roller in the vicinity of a contact point between the intermediate transfer roller and the recording medium.

In the image formation apparatus having the aforementioned configuration, a visible image is transferred from the photosensitive body onto the intermediate transfer roller, which is rotated with the visible image. The visible image is then transferred from the intermediate transfer roller onto the recording medium.

When the visible image is transferred to the recording medium, the intermediate transfer roller lowers its surface temperature because the recording medium takes heat from the intermediate transfer roller.

The heating roller is brought into contact with the intermediate transfer roller after the visible image transferred to the fixing roller. Thus, the heat lost is rapidly compensated before starting of the next image formation by the intermediate transfer roller. Thus, it is possible to maintain the intermediate transfer roller surface at a predetermined temperature.

Furthermore, the claw member arranged around this heating roller serves to prevent useless radiation of heat from the heating roller, thus enabling to effectively supply heat to the intermediate transfer roller.

According to another aspect of the present invention, there is provided an image formation apparatus comprising: a photosensitive body of an endless belt shape; an electric charger for charging the photosensitive body; an exposure device for forming an electrostatic latent image on the photosensitive body; a developing device for forming a visible image according to the electrostatic latent image; a developing solution supply device for supplying to the developing device a developing solution used for forming the visible image; an intermediate transfer roller for transferring the visible image from the photosensitive body onto a recording medium; a fixing roller for fixing the visible image which has been transferred from the intermediate transfer roller onto the recording medium; and a transfer assisting roller having a built-in heat source and arranged in contact with the rear surface of the photosensitive body so as to press the surface of the photosensitive body against the intermediate transfer roller.

In the image formation apparatus having the aforementioned configuration, a visible image formed on the belt-shaped photosensitive body is subjected to heat and pressure from the transfer assisting roller and transferred to the intermediate transfer roller. The visible image is fed by the rotation of the intermediate transfer roller and subjected to heat and pressure from the fixing roller when transferred and fixed to a recording medium.

According to still another aspect of the present invention, there is provided an image formation apparatus comprising: a photosensitive body of an endless belt shape; an electric charger for charging the photosensitive body; an exposure device for forming an electrostatic latent image on the photosensitive body; a developing device for forming a visible image according to the electrostatic latent image; a developing solution supply device for supplying to the developing device a developing solution used for forming the visible image; an intermediate transfer roller having a built-in heat source for transferring the visible image from the photosensitive body onto a recording medium; a fixing roller for fixing the visible image which has been transferred from the intermediate transfer roller onto the recording medium; and a transfer assisting roller having an outer circumference covered with a resin layer and arranged in contact with the rear surface of the photosensitive body so as to press the surface of the photosensitive body against the intermediate transfer roller.

DESCRIPTION OF THE PREFERRED EMBODIMENTS

Description will now be directed to preferred embodiments with reference to the attached drawings.

Figure 1:
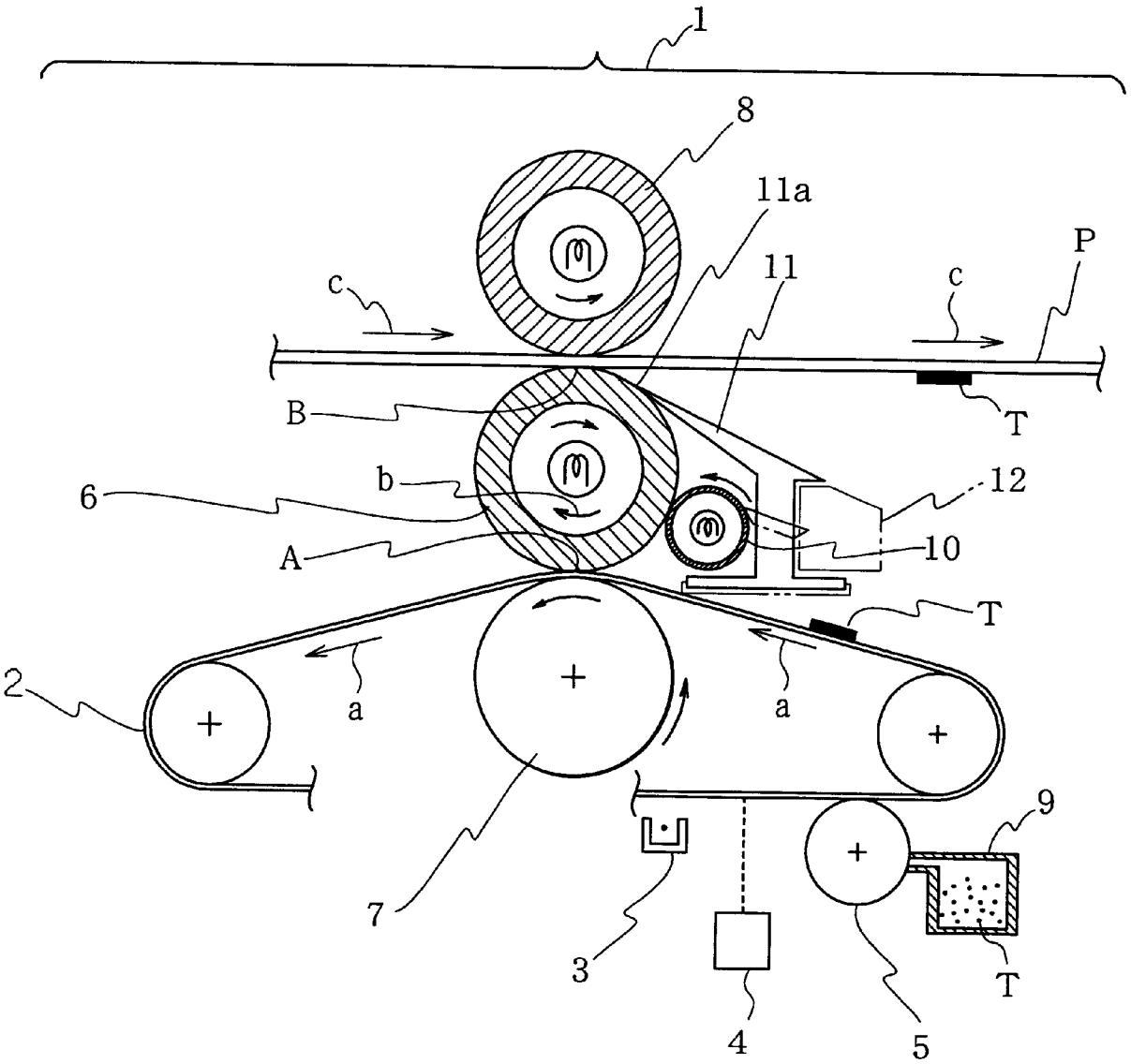
FIG. 1 is a cross sectional view of an essential portion for performing transfer-fixation in an image formation apparatus according to a first embodiment of the present invention.

FIG. 1 is a cross sectional view of an image formation apparatus 1 according to a first embodiment of the present invention.

The image formation apparatus 1 includes: an endless belt-shaped photosensitive body 2; an electric charger 3 for charging the belt-shaped photosensitive body; an exposure device 4 for forming an electrostatic latent image on this photosensitive body 2 electrically charged; a developing device 5 for forming a visible image based on the electrostatic latent image; a toner supply device 9 for supplying the developing device 5 with a toner T for use in the formation of the visible image; an intermediate transfer roller 6 for transferring the visible image from the photosensitive body 2 onto a recording medium P; a fixing roller 8 for fixing the visible image transferred from the intermediate transfer roller to the recording medium P; and a claw member 11 to assist peeling off of the recording medium P from the intermediate transfer roller 6.

The image formation apparatus 1 further includes a heating roller 10 which is arranged so as to be in contact with a non-toner side (right side in FIG. 1) of the outer circumference of the intermediate transfer roller 6, i.e., after a toner image transferred to the intermediate roller 6 at a nip portion A is fixed to the fixing roller 8 at a nip portion B.

Moreover, the image formation apparatus 1 includes a claw member 11 arranged so as to surround the heating roller 10 and having a claw 11*a* which is in contact with the outer circumference of the intermediate transfer roller 6 immediately after a toner image is fixed to the fixing roller 11.

Next, explanation will be given on each of the components of the image formation apparatus 1.

The photosensitive body 2 has an endless belt shape supported by a plurality of support rollers and fed in the direction indicated by an arrow "a".

The electric charger 3 applies a predetermined initial voltage to the belt-shaped photosensitive body 2. The exposure device 4 performs exposure onto the belt-shaped photosensitive body 2 according to an image data using a laser beam, LED, or liquid crystal back light. Thus, an electrostatic latent image is formed, to which toner T is applied to form a visible image.

The toner supply device 9 contains the toner T and supplies a predetermined amount of toner T to the developing device 5.

The intermediate transfer roller 6 is in contact with the photosensitive body 2 at the nip portion A having a predetermined nip width. The visible image formed on the surface of the photosensitive body 2 is temporarily carried by the intermediate transfer roller 6 and then brought into contact with the recording medium P at the nip portion B having a predetermined nip width. Thus, the visible image is transferred onto the recording medium P.

The intermediate transfer roller 6 is rotatably arranged so that its full width is in contact with the belt-shaped photosensitive body.

The intermediate transfer roller 6 has a built-in heat source and maintains its surface at a predetermined temperature. However, the intermediate transfer roller 6 may not have any heating source if the heating roller 10 can supply a sufficient heat to maintain the predetermined temperature.

The surface temperature of this intermediate transfer roller 6 is detected by a temperature detecting thermistor (not depicted). The power source of the heat source is turned on and off according to a temperature detected so that the surface temperature of the intermediate transfer roller 6 is maintained at a predetermined temperature.

The intermediate transfer roller 6 includes a core roller made from a metal or the like having conductivity, which is covered with a resin layer such as a rubber layer.

The transfer assisting roller 7 is arranged adjacent to the intermediate transfer roller 6 so as to sandwich the belt-shaped photosensitive body 2. That is, the transfer assisting roller 7 supports the belt-shaped photosensitive body from its back side so as to maintain its tension and presses the belt-shaped photosensitive body 2 against the intermediate transfer roller 6 with a predetermined pressure, so that the visible image is preferably transferred from the surface of the photosensitive body 2 onto the intermediate transfer roller 6. Moreover, the transfer assisting roller 7 is made from metal such as aluminium and stainless steel, or a heat-resistance plastic.

The fixing roller 8 is arranged adjacent to the intermediate transfer roller 6 so as to sandwich the feed path of the recording medium P. That is, the fixing roller 8, at the nip portion B, pushes the recording medium P from its back side against the intermediate transfer roller 6 with a predetermined temperature and pressure, so that the visible image is transferred from the surface of the intermediate transfer roller 6 onto the recording medium P.

The fixing roller 8 also has a built-in heat source. Moreover, the fixing roller is made from a metal such as aluminum and stainless steel or a heat-resistance plastic. The fixing roller 8 may have a surface covered with a fluorine resin so as to prevent from being stained.

Moreover, the intermediate transfer roller 6 is arranged between the transfer assisting roller 7 and the fixing roller 8, and has its rotation axis extending in a direction parallel to the rotation axis of the transfer assisting roller 7 and the rotation axis of the fixing roller 8.

With this configuration, when the belt-shaped photosensitive body 2 is driven in the direction "a", the intermediate transfer roller 6 and the fixing roller 8 are rotated to follow the feed of the belt-shaped photosensitive body 2.

That is, the belt-shaped photosensitive body 2 alone is driven and this causes the rotation of all of the intermediate transfer roller 6, the transfer assisting roller 7, and the fixing roller 8. The recording medium P is fed in the direction "c" and an image is formed on the recording medium P.

The heating roller 10 is arranged so as to be in contact with the non-toner side of the outer circumference of the intermediate transfer roller 6.

The heating roller 10 has a built-in heat source. The heating roller 10 has its surface covered with a material having an excellent thermal conductivity. Moreover, the cylindrical heating roller 10 is in contact with the intermediate transfer roller 6 without causing a physical resistance, so as to apply heat uniformly to the intermediate transfer roller 6.

Here, the heating roller 10 has its surface covered with a resin layer such as fluorine resin. This enables to remove a remaining toner T from the surface of the intermediate transfer roller 6.

Because of various reasons, some toner remains on the surface of the intermediate transfer roller 6. This toner residue, if attached to an image to be formed, deteriorates the image quality. Such toner residue is removed by the heating roller 10 so as to eliminate adverse affect which may be caused by the toner residue and maintain a predetermined image quality of the image formation apparatus 1.

This heating roller 10 also has a function to clean the surface of the intermediate transfer roller 6. Accordingly, there is no need of providing a particular cleaning roller. This contributes to further reduction in the size of the image formation apparatus 1.

The claw member 11 has the claw portion 11*a* to assist peeling off of the recording medium from the intermediate transfer roller 6. The claw portion 11*a* is in contact with a point on the non-toner side of the intermediate transfer roller 6.

This claw portion 11*a* of the claw member 11 can be made from a metal or elastic plastic or resin. Moreover, the claw portion 11*a* is formed with a small thickness so as to be inserted between the recording medium P and the intermediate transfer roller 6 so that the recording medium P is peeled off from the intermediate transfer roller 6.

In this case, the intermediate transfer roller 6 can have a surface material selected according to the material of the recording medium P.

After transfer onto the recording medium P, the surface of the intermediate transfer roller 6 is brought into contact with the claw member 11 and accordingly, the residual toner is removed from the surface of the intermediate transfer roller 6. The toner removed falls into a waste toner box 12.

Thus, the claw member 11 also has the function to clean the intermediate transfer roller 6.

The claw member 11 is formed in a U shape to surround the heating roller 10 in its entire width excluding the contact portion with the intermediate transfer roller 6.

This U-shaped claw member 11 suppresses heat radiation from the surface of the heating roller 10 and the surface of the intermediate transfer roller 6. This enables to increase the thermal efficiency and to provide an image formation apparatus of energy saving type.

In this case, instead of the U shape, the claw member 11 may also be formed so match with the external configuration of the heating roller 10 and the intermediate transfer roller 6, so as to eliminate any useless space.

Thus, the visible image is transferred from the photosensitive body 2 onto the intermediate transfer roller 6. The intermediate transfer roller 6 carries the visible image while rotating in the direction "b". Next, this intermediate transfer roller 6 carrying the visible image is brought into contact with the recording medium P and transfers the visible image onto the recording medium P. Thus, the image formation is performed.

The intermediate transfer roller 6 which has formed an image on the recording medium P is deprived of heat, lowering its surface temperature than the predetermined set temperature.

The heating roller 10 is brought into contact with the non-toner side of the intermediate transfer roller 6. That is, before starting a next image formation by the intermediate transfer roller 6, the heating roller 10 supplies a heat to the intermediate transfer roller 6 so as to maintain the surface temperature of the intermediate transfer roller 6.

Furthermore, the heating roller 10 which is surrounded by the claw member 11 can effectively supply heat to the intermediate transfer roller 6.

With the aforementioned configuration, it is possible to provide a small-size image formation apparatus of energy saving type capable of uniformly heating the surface of the intermediate transfer roller 6 and maintaining the entire surface at a predetermined temperature.

Figure 2:
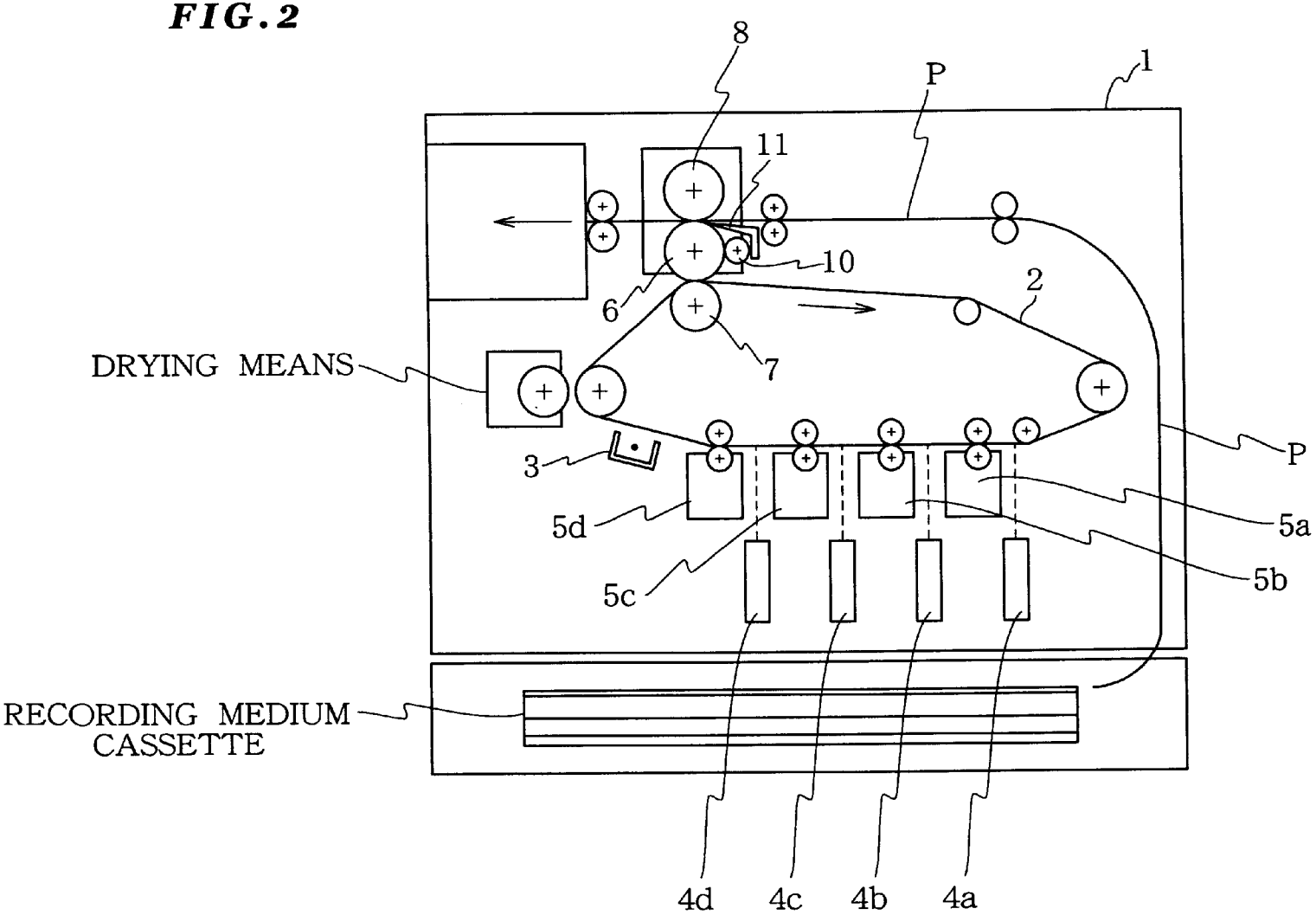
FIG. 2 is a cross sectional view of the entire configuration of the image formation apparatus of the first embodiment.

FIG. 2 is a cross sectional view of the entire configuration of the image formation apparatus according to the present embodiment as a color image formation apparatus of electro-photographic type.

In the image formation apparatus 1, the endless belt-shaped photosensitive body 2 is fed to pass by the electric charger 3 and four sets of exposure devices 4*a* to 4*d* and for forming an electrostatic latent image for each of the colors and the developing devices 5*a* to 5*d* for forming a visible image of each of the colors (yellow, magenta, cyan, and black) according to the electrostatic latent image.

Moreover, drying means is provided along the feed path of the photosensitive body 2. At the downstream from the drying means, there are arranged the transfer assisting roller 7, the intermediate transfer roller 6, the heating roller 10, and the fixing roller 8. Moreover, the claw member 11 is provided to assist peeling off of the recording medium P from the intermediate transfer roller 6.

The recording medium P on which an image is to be formed is contained in a recording medium cassette so as to be fed therefrom.

In an image forming process, the photosensitive body 2 is charged to a predetermined potential by the electric charger 3 and firstly a latent image corresponding to a yellow image is formed by the yellow exposure device 3*a*. The developing device 5*a* has Yellow toner which is supplied to the photosensitive body 2 so as to form a yellow image.

After Yellow, the process of exposure and development is repeated successively for each of the colors, Magenta, Cyan, and Black, so as to develop a full color image of four colors. After development of the full-color image four colors, residual ink and ink solvent remaining on the photosensitive body is removed by the drying means provided along the path of the photosensitive body 2. Thus, a clear image is obtained.

The image is then transferred to the intermediate transfer roller 6. A color image formation requires more time than a monochromatic image formation because it is necessary to perform development for each of the colors. In a color image formation apparatus, it is indispensable, during an image formation, to maintain the surface of the intermediate transfer roller 6 at a predetermined temperature to obtain a high quality image.

On the other hand, the color image formation apparatus tends to increase its size because a number of components are required. However, the color image formation apparatus should reduce its size if it is to be used as a wide-spread apparatus.

The present embodiment enables to provide an image formation apparatus of a reduced size and energy-saving type in which the surface of the intermediate transfer roller is uniformly heated to maintain the entire surface at a predetermined temperature, thus enabling to maintain a high quality of image.

This is especially beneficial for a color image formation apparatus.

The visible image which has been transferred to the intermediate transfer roller 6 is then transferred onto the recording medium P and fixed by the fixing roller 8 to recording medium P, thus completing an image formation.

Figure 3:
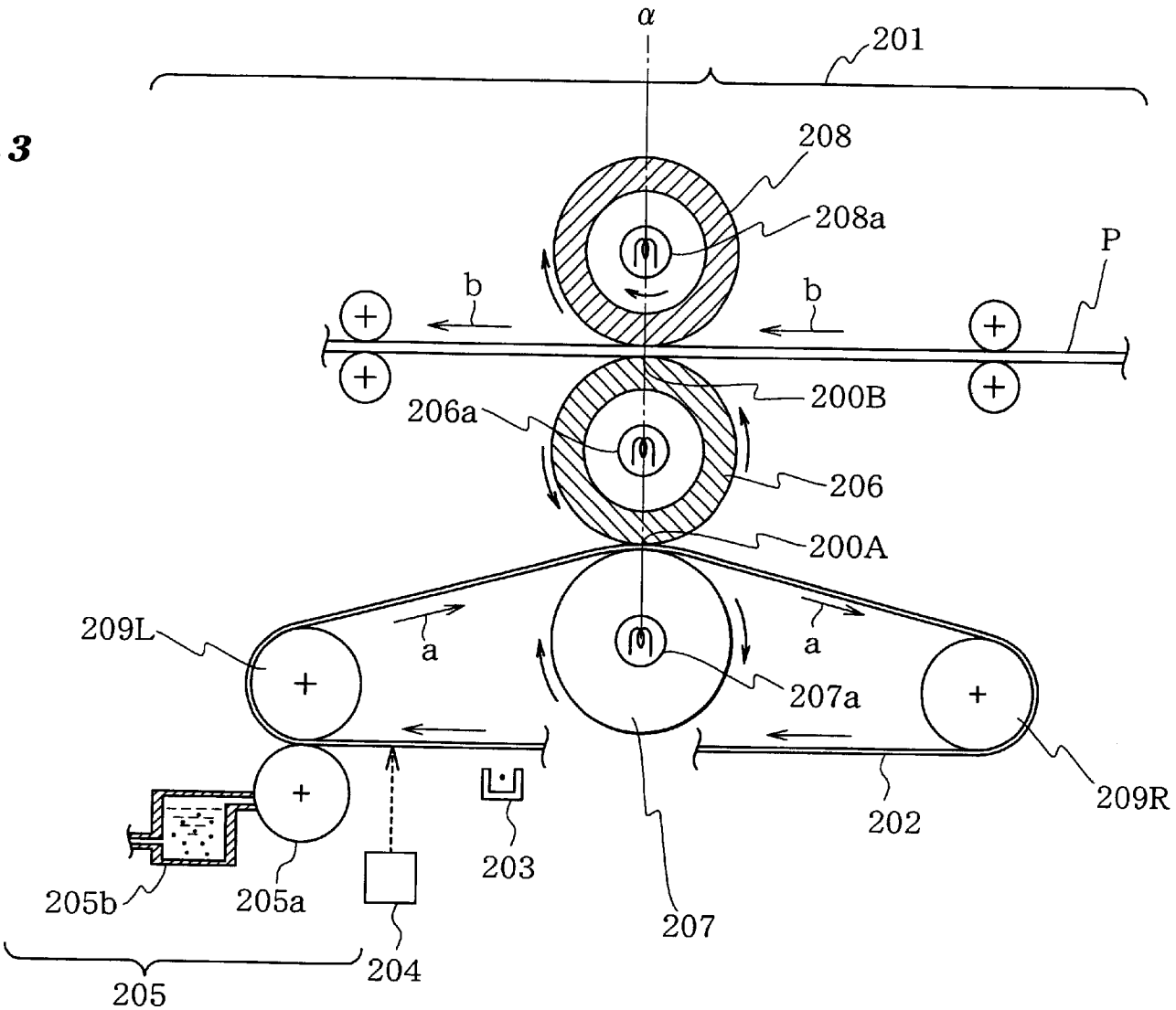
FIG. 3 is a cross sectional view of an essential portion for performing transfer-fixation in an image formation apparatus according to a second embodiment of the present invention.

FIG. 3 is a cross sectional view of an essential portion of an image formation apparatus 201 according to a second embodiment of the present invention.

The image formation apparatus 201 includes: an endless belt-shaped photosensitive body 202; an electric charger 203 for charging the belt-shaped photosensitive body 202; an exposure device 204 for forming an electrostatic latent image on the charged photosensitive body 202; a developing roller 205*a* for forming a visible image according to this electrostatic latent image; a developing solution supply device 205*b* for supplying to the developing roller 205*a* used in forming the visible image; an intermediate transfer roller 206 for transferring the visible image from the photosensitive body 202 to a recording medium P; and a fixing roller 208 for fixing the visible image which has been transferred from the intermediate transfer roller 206 to the recording medium P.

The image formation apparatus 201 further includes a transfer assisting roller 207 arranged in contact with a rear surface of the photosensitive body 202 so as to press the main surface (image formation surface) of the photosensitive body 202 against the intermediate transfer roller 206.

Moreover, this transfer assisting roller 207 has a built-in heat source 207*a*.

Next, explanation will be given on the respective components of this image formation apparatus of the second embodiment.

The belt-shaped photosensitive body 202 has a predetermined sensitivity and a predetermined printing resistance, and is made from ZnS, CdS, Se alloy, OPC (organic photosensitive compound), amorphous silicon, and other material.

This endless belt-shaped photosensitive body 2 is supported by at least one support rollers 209R, 209L in addition to the transfer assisting roller 207 and fed in the direction of "a".

The developing solution supply device 205*b* contains a developing solution which is supplied in a predetermined amount to the developing roller 205*a*. The developing solution used in this image formation apparatus 201 is the toner T dispersed in a carrier liquid.

Moreover, the cylindrical transfer assisting roller 207 is arranged to be in contact with the photosensitive body 202 causing no physical resistance and uniformly applies heat to a transfer portion of the photosensitive body 202 sandwiched between the transfer assisting roller 207 and the intermediate transfer roller 206.

The transfer assisting roller 207 may have a built-in heat source 207*a* or may be covered with a heating layer made from an electric resistor. The heat source 207*a* is set so as to have a sufficient calorific power to rapidly heat the surface of the intermediate transfer roller 206 up to a predetermined temperature and maintain the temperature. However, the calorific power should be below the glass transition temperature of the substrate of the photosensitive body 202. If the glass transition temperature is exceeded, the photosensitive characteristic of the photosensitive body 202 may be deteriorated.

Figure 4:
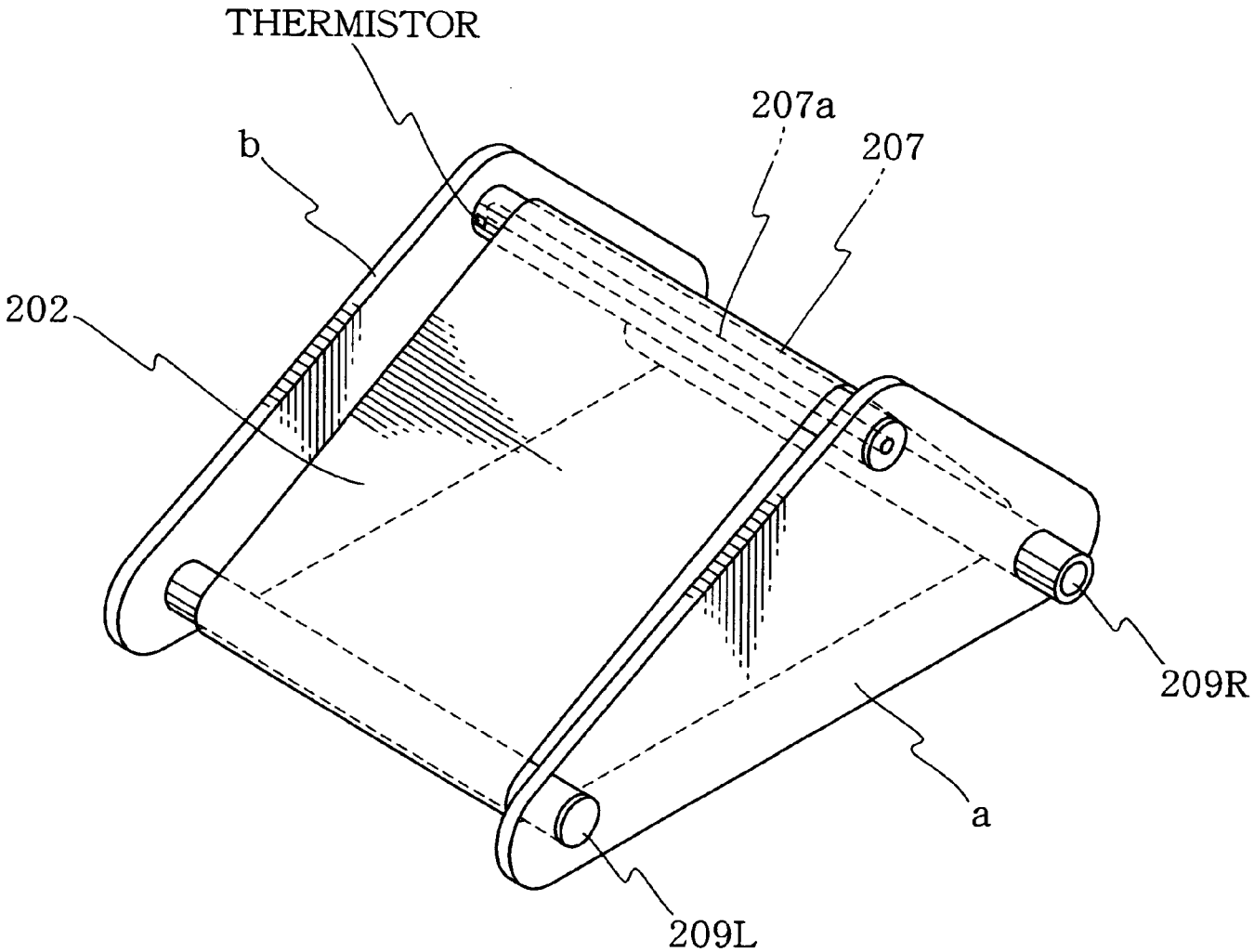
FIG. 4 is a perspective view of a belt-shaped photosensitive body of the image formation apparatus of the second embodiment.

FIG. 4 shows a detailed configuration of the belt-shaped photosensitive body supported by the transfer assisting roller 207 and the support rollers 209R and 209L.

The belt-shaped photosensitive body 202 is given a predetermined tension by the support rollers 209R and 209L. One (209R) of the support rollers has a rotation drive block for driving the photosensitive body 202 to rotate around the support rollers 209R, 209L and the transfer assisting roller 207 which are preferably arranged, when viewed from side, in an isosceles triangle with a base determined by the two support rollers 209R and 209L.

The belt-shaped photosensitive body 202 is fed while being guided by a pair of side frames "a" and "b" provided as triangle members at both ends of the support rollers 209R, 209L, and the transfer assisting roller 207

This configuration enables to obtain a uniform tension over the entire width of the belt-shaped photosensitive body 202 so that the photosensitive body 202 can be fed smoothly, enabling to obtain preferable transfer from the photosensitive body 202 to the intermediate transfer roller 206. The number of support rollers 209 and their positional relationship with the transfer assisting roller can be determined, considering the entire size of the image formation apparatus 201, length of the photosensitive body 202, and the like.

The intermediate transfer roller 206 is arranged to rotate while being in contact with the entire width of the belt-shaped photosensitive body 202. The intermediate transfer roller 206 includes a metal core roller having an electric conductivity which is covered with a resin layer such as fluorine resin or rubber layer having a low thermal conductivity.

This intermediate transfer roller 206 has a built-in heat source 206*a* for assisting to maintain its surface at a predetermined temperature.

By heating from both of the transfer assisting roller 207 and the intermediate transfer roller 206, it is possible to assure a stable heat supply and easily maintain the surface temperature of the intermediate transfer roller 206.

Furthermore, this configuration enables to reduce the time required until the surface of the intermediate transfer roller 206 reaches a predetermined temperature. That is, it is possible to reduce the time required from the power switch on until a printing enabled state is obtained. Thus, it is possible to obtain a rapid rise of the image formation apparatus.

It should be noted that, if the transfer assisting roller 207 alone can supply a sufficient heat to maintain the predetermined temperature, the intermediate transfer roller 206 may not contain the heat source 206*a*.

The surface temperature of this intermediate transfer roller 206 is detected by a thermistor (not depicted). According to the temperature detected, the power sources of the heat sources 206*a*, 207*a*, and 208*a* are turned on and off for controlling the surface temperature of the intermediate transfer roller 206.

With the aforementioned configuration, the intermediate transfer roller 206 and the fixing roller 208 are rotated following the feed of the belt-shaped photosensitive body 206.

That is, driving the belt-shaped photosensitive body 202 alone causes rotation of the intermediate transfer roller 206, the transfer assisting roller 207, and the fixing roller 208 as well as feed of the recording medium P in the direction of "b".

Furthermore, in this embodiment, the transfer assisting roller 207 is arranged in such a manner that its center point is positioned on a line a (FIG. 3) connecting the center point of the fixing roller 208 and the center point of the intermediate transfer roller 206.

Thus, the intermediate transfer roller 206 are sandwiched by and pressed by the fixing roller 208 and the transfer assisting roller 207 from the opposite directions, i.e., from the nip portion 200B and the nip portion 200A which are located at symmetric positions with respect to the center of the intermediate transfer roller 206.

That is, when an image is transferred from the photosensitive body 202 onto the intermediate transfer roller 206, the pushing force of the transfer assisting roller 207 against the intermediate transfer roller 206 is compensated by the pushing force of the fixing roller 208 against the intermediate transfer roller 206.

Accordingly, for the image transfer from the photosensitive body 202 to the intermediate transfer roller 20, the transfer assisting roller 207 can apply a sufficient force to the intermediate transfer roller 206, enabling to perform preferable transfer.

In the image formation apparatus having the aforementioned configuration, shafts of the transfer assisting roller 207, the intermediate transfer roller 206, and the fixing roller 208 are not affected by the aforementioned pressing forces. That is, the pressing forces will not cause shifting of the shafts from their original position, enabling to maintain a preferable printing quality for a long period of time.

Moreover, during maintenance, inspection, or adjustment, the fixing roller 208, the intermediate transfer roller 206, and the transfer assisting roller 207 can be positioned easily because their rotation axes are aligned in a single plane.

In this configuration, the visible image formed on the belt-shaped photosensitive body 202 is subjected to heat and pressure from the transfer assisting roller 207 and transferred to the intermediate transfer roller 206.

Here, the photosensitive body 202 radiates heat while being fed. If the photosensitive body 202 in this state is brought into contact with the intermediate transfer roller 206, the surface temperature of the intermediate transfer roller 206 is lowered.

To cope with this, in this embodiment, the transfer assisting roller 207 having the heat source 207*a* is arranged so as to simultaneously apply a heat and pressure to a contact portion between the belt-shaped photosensitive body 202 and the intermediate transfer roller 206.

That is, the transfer assisting roller 207 can effectively apply heat only to the aforementioned contact portion between the photosensitive body 202 and the intermediate transfer roller 206. This contributes to energy saving of the image formation apparatus.

The visible image which has been transferred to the intermediate transfer roller 206 is fed by the rotation of the intermediate transfer roller 206 and subjected to the heat and pressure from the fixing roller 208 so as to be transferred and fixed to the recording medium.

Figure 6:
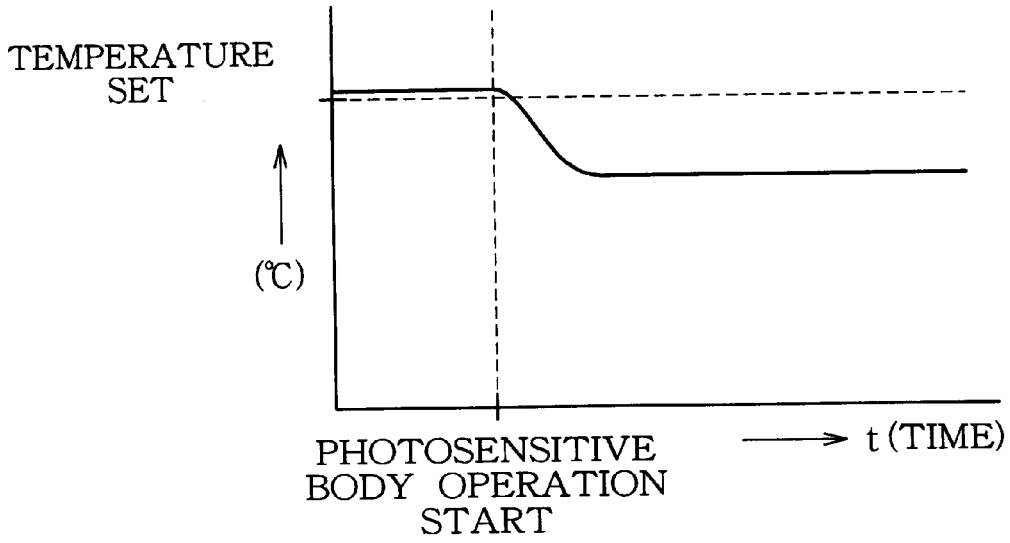
FIG. 6A shows a surface temperature transition of the intermediate transfer roller when no heat source is provided in the transfer assisting roller 7.
FIG. 6B shows a surface temperature transition of the intermediate transfer roller when a heat source is provided in the transfer assisting roller 7.
Figure 6:
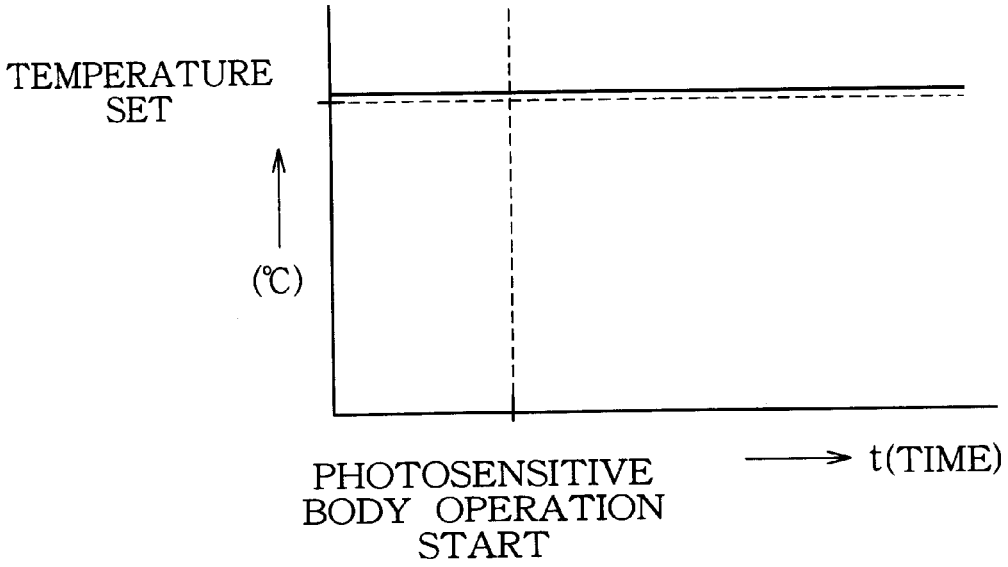

FIG. 6 shows the effect given by the transfer assisting roller 207 to maintain the surface temperature of the intermediate transfer roller 206.

FIG. 6A shows a surface temperature transition of the intermediate transfer roller 206 when the transfer assisting roller 207 has no heat source; and FIG. 6B shows a surface temperature transition of the intermediate transfer roller 206 when the transfer assisting roller 207 has the heat source 207*a*.

As shown in FIG. 6A, when the transfer assisting roller 207 has no heat source, the surface temperature of the intermediate transfer roller 206 is rapidly lowered after the operation of the photosensitive body 202 is started. On the other hand, as shown in FIG. 6B, when the transfer assisting roller 207 has the heat source 207, the surface temperature of the intermediate transfer roller 206 is maintained at the predetermined temperature after operation of the photosensitive body is started.

Thus, the built-in heat source 207*a* of the transfer assisting roller enables to maintain the predetermined surface temperature of the intermediate transfer roller 206, enabling to maintain a preferable printing quality.

Figure 5:
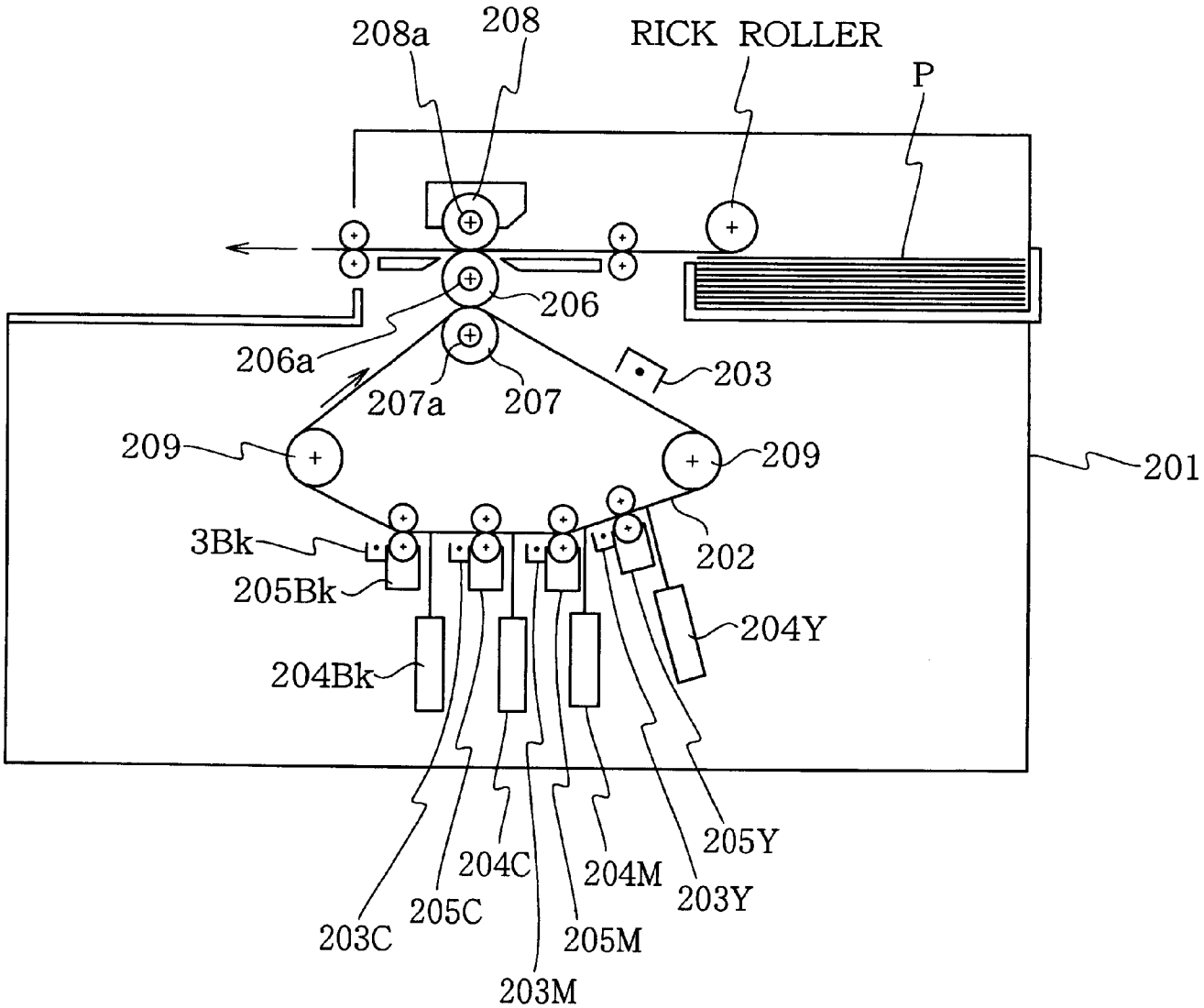
FIG. 5 is a cross sectional view of the entire configuration of the image formation apparatus of the second embodiment.

FIG. 5 is a cross sectional view of the entire configuration of the image formation apparatus 201 according to the present embodiment as a color image formation apparatus of electro-photographic type.

In the image formation apparatus 201, the endless belt-shaped photosensitive body 202 is fed to pass by the electric charger 203 and four sets of exposure devices 204Y (for Yellow), 204M (for Magenta), 204C (for Cyan), 204Bk (for black) and developing devices 205Y, 205M, 205C, and 205Bk for forming a visible image of each of the colors (yellow, magenta, cyan, and black) according to the electrostatic latent image.

Moreover, the transfer assisting roller 207 and the intermediate transfer roller 206 are arranged to sandwich the feed passage of the photosensitive body 202 as has been shown in FIG. 3.

The recording medium P on which an image is to be formed is contained in a hopper so as to be fed out by a pick roller therefrom.

In an image forming process, the photosensitive body 202 is charged to a predetermined potential by the electric charger 203 and firstly a latent image corresponding to a yellow image is formed by the yellow exposure device 203Y. The developing device 205Y has Yellow toner supplied to the photosensitive body 202 so as to form a yellow image.

After Yellow, the process of exposure and development is repeated successively for each of the colors, Magenta, Cyan, and Black, so as to develop a full color image of four colors. After the full-color image of four colors is developed, the photosensitive body 202 is fed so as to carry the visible image up to the nip portion 200A (FIG. 3), i.e., the contact portion with the intermediate transfer roller 206, so that the full-color visible image is transferred to the intermediate transfer roller 206.

In order to maintain the entire surface of the intermediate transfer roller 206 at a predetermined temperature, it is necessary to form a hollow cylindrical intermediate roller 206 having a large wall thickness made from a material having a large heat capacity or to provide an apparatus for heating the entire surface of the intermediate transfer roller 206.

On the other hand, the color image formation apparatus tends to increase its size because a number of components are required. However, the color image formation apparatus should reduce its size if it is to be used as a wide-spread apparatus.

In the present embodiment, the arrangement of the belt-shaped photosensitive body 202 and the transfer assisting roller 207 enables to effectively heat a transfer portion immediately before transferred from the photosensitive body 202 to the intermediate transfer roller 206. This enables to maintain the entire surface at a predetermined temperature, thus enabling to maintain a high quality of image.

This feature is especially beneficial in a color image formation apparatus.

The visible image which has been transferred to the intermediate transfer roller 206 is then transferred onto the recording medium 200P and fixed by the fixing roller 208 to recording medium 200P with a predetermined heat and pressure, thus completing an image formation.

Figure 7:
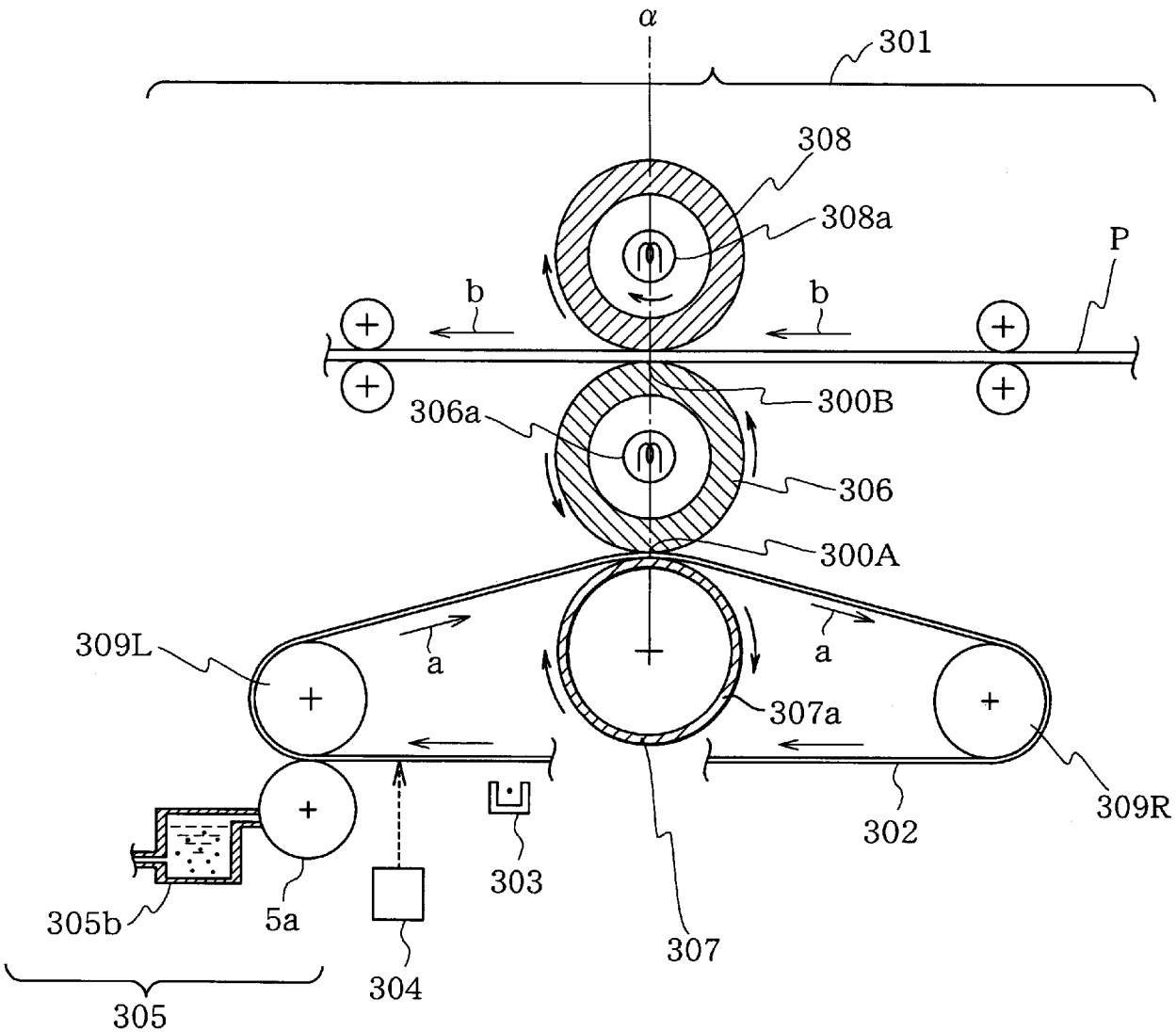
FIG. 7 is a cross sectional view of an essential portion for performing transfer-fixation in an image formation apparatus according to a third embodiment of the present invention.

Next, FIG. 7 is a cross sectional view showing an essential portion of the image formation apparatus 301 according to the third embodiment of the present invention.

The image formation apparatus 301 includes: an endless belt-shaped photosensitive body 302; an electric charger 303 for charging the belt-shaped photosensitive body; an exposure device 304 for forming an electrostatic latent image on the photosensitive body 302 charged; developing roller 305*a* for forming a visible image according to the electrostatic latent image; a developing solution supply device 305*b* for supplying to the developing roller 305 a developing solution to be used for forming the visible image; an intermediate transfer roller 306 for transferring the visible image from the photosensitive body 302 to the recording medium 300P; and a fixing roller 308 for fixing the visible image which has been transferred from the intermediate transfer roller 306 to the recording medium 300P.

The image formation apparatus 301 further includes a transfer assisting roller 307 arranged so as to be in contact with the rear surface of this photosensitive body 302 and to press the main surface (image formation surface) of the photosensitive body 302 against the intermediate transfer roller 306.

Moreover, this transfer assisting roller 307 is covered with a resin layer 307*a*.

Next, explanation will be given on respective components of the image formation apparatus 301 of the third embodiment.

The transfer assisting roller 307 is arranged so as to press the belt-shaped photosensitive body 302 against the intermediate transfer roller 306. That is, the transfer assisting roller 307 supports the belt-shaped photosensitive body 302 from its rear surface so as to maintain tension of the belt-shaped photosensitive body 302 and press the belt-shaped photosensitive body 302 with a predetermined pressure against the intermediate transfer roller 306, so that the visible image formed on the photosensitive body 302 is preferably transferred onto the intermediate transfer roller 306.

The transfer assisting roller 307 has a surface covered with a resin layer 307*a* not to deprive heat of the surface of the intermediate transfer roller 306 when pressed via the photosensitive body 302 against the intermediate transfer roller 306.

The resin layer 307*a* may be any resin having a low thermal conductivity such as fluorine resin or a paint type resin and may be made from a film-shaped resin.

Moreover, the transfer assisting roller 307 has a built-in heat source. By reducing the temperature difference between the transfer assisting roller 307 and the surface of the intermediate transfer roller 306, it is possible not to deprive the heat of the intermediate transfer roller 306.

The transfer assisting roller 307 preferably has a core made from a material having a high thermal conductivity such as aluminum, stainless steel and other metal, or a heat-resistant plastic.

With the aforementioned configuration, the visible image formed on the belt-shaped photosensitive body 2 is subjected to the pressure from the transfer assisting roller 307 and transferred onto the intermediate transfer roller 307. Here, the transfer assisting roller 307 covered with the resin layer 307*a* does not deprive the heat of the surface of the intermediate transfer roller 306.

In this embodiment, arrangement of the photosensitive body 302 having an endless belt shape and the transfer assisting roller covered with the resin layer 307*a* enables to compensate the defect that surface temperature of the intermediate transfer roller 306 is lowered by the contact between the transfer assisting roller 307 and the belt-shaped photosensitive body 302. Moreover, with the aforementioned configuration, a preferable pressure can be applied to the contact portion of the photosensitive body 302 with the intermediate transfer roller 306 for transferring an image.

Moreover, when the transfer assisting roller 307 has a heat source, it is possible to effectively heat only the portion of the photosensitive body 302 where an image is transferred to the intermediate transfer roller 306. Thus, it is possible to obtain an image formation apparatus of energy saving type.

Figure 8:
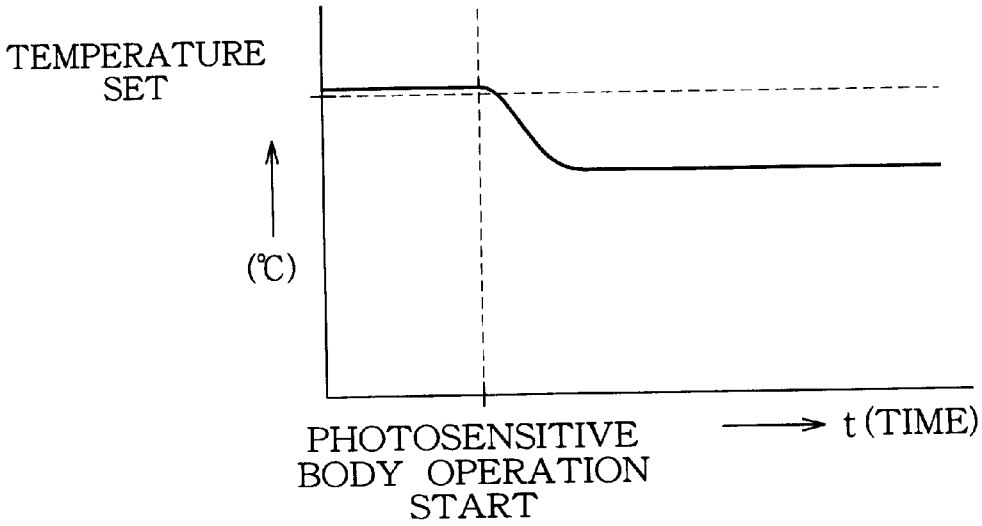
FIG. 8A shows a surface temperature transition of the intermediate transfer roller when the transfer assisting roller 7 is not covered with a resin layer.
FIG. 8B shows a surface temperature transition of the intermediate transfer roller when the transfer assisting roller 7 is covered with a resin layer.
Figure 8:
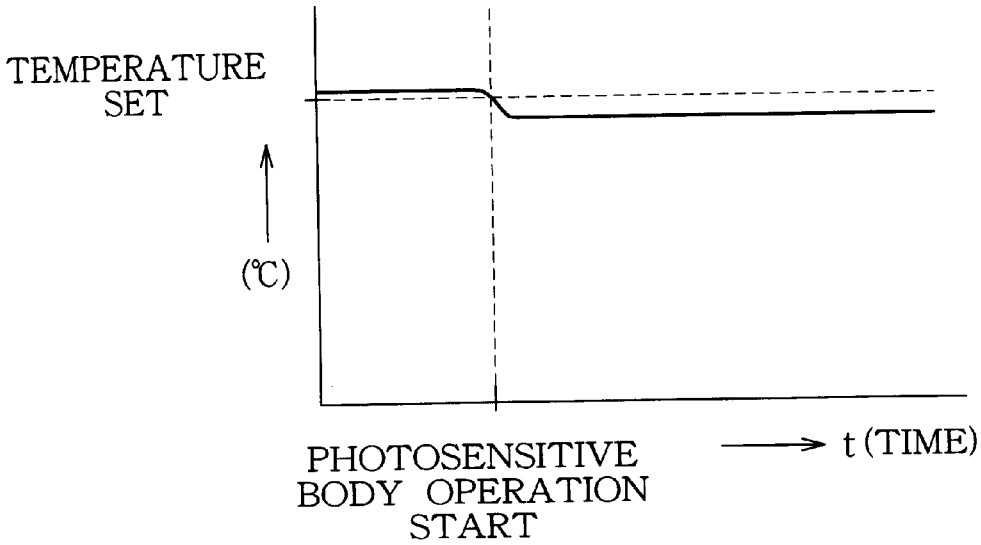

FIG. 8A shows a surface temperature transition of the intermediate transfer roller 306 when the transfer assisting roller 307 is not covered with the resin layer 307*a;* and FIG. 8B shows a surface temperature transition of the intermediate transfer roller 306 when the transfer assisting roller 307 is covered with the resin layer 307*a.*

As shown in FIG. 8A, when the transfer assisting roller 307 is not covered with the resin layer 307*a,* the surface temperature of the intermediate transfer roller 306 is rapidly lowered with the start of the operation of the photosensitive body 302. On the other hand, as shown in FIG. 8B, when the transfer assisting roller 307 is covered with the resin layer 307*a,* the surface temperature of the intermediate transfer roller 306 is not lowered to that degree as in the case when the resin layer 307*a* is not provided. This is because the resin layer 307*a* on the surface of the transfer assisting roller 307 prevents heat movement from the intermediate transfer roller 306.

Thus, the resin layer 307*a* covering the transfer assisting roller 307 eliminates affects of the transfer assisting roller 307 and the photosensitive body 302 upon the surface temperature of the intermediate transfer roller 306, thus enabling to maintain the surface temperature of the intermediate transfer roller 306 at a constant temperature. This enables to maintain a preferable printing quality.

In this embodiment, the belt-shaped photosensitive body 302 and the transfer assisting roller 307 are arranged in such a way that the photosensitive body 302 is in pressed contact with the intermediate transfer roller 306 where an image is to be transferred, without affecting the surface temperature of the intermediate transfer roller 306. Thus, it is possible to maintain a predetermined temperature, which in turn enables to obtain a high quality image.

As has been described above, the present invention employs the cylindrical heating roller as an auxiliary heat source for heating the intermediate transfer roller. By use of this heating roller in combination with the claw member, the present invention enables to effectively compensate the heat lost from the intermediate transfer roller.

Moreover, by using the heating roller as cleaning means, the heating roller can preferably remove remaining toner from the surface of the intermediate transfer roller. That is, by eliminating affects from the remaining toner, it is possible to obtain a high quality printing.

Moreover, the transfer assisting roller is arranged in contact with the rear surface of the belt-shaped photosensitive body so as to press the main surface (image formation surface) of the photosensitive body against the intermediate transfer roller. The built-in heat source in the transfer assisting roller applies heat to the intermediate transfer roller and the photosensitive body.

This transfer assisting roller can effectively compensate the heat lost from the intermediate transfer roller when the surface of the intermediate transfer roller is brought into contact with the belt-shaped photosensitive body.

Thus, by maintaining at a predetermined temperature only the transfer portion of the surface of the intermediate transfer roller, it is possible to eliminate adverse effect caused by temperature change of the intermediate transfer roller upon printing quality, thus enabling to obtain a high printing quality.

This arrangement of the belt-shaped photosensitive body and the transfer assisting roller enables to heat only the transfer portion of the intermediate transfer roller so as to maintain a predetermined printing quality as well as to provide a small-size energy-saving image formation apparatus.

Furthermore, the transfer assisting roller which is in brought into contact with the photosensitive body is covered with a resin layer. Thus, while pressing with a sufficient pressure the photosensitive body against the intermediate transfer roller, it is possible to prevent useless heat radiation from the surface of the intermediate transfer roller, which in turn enables to maintain a high printing quality. Thus, it is possible to provide a small-size energy-saving image formation apparatus.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-120242 (Filed on Apr. 30, 1998), Japanese Patent Application No. 10-124594 (Filed on May 7, 1998), Japanese Patent Application No. 10-165113 (Filed on Jun. 12, 1998) including specification, claims, drawings and summary are incorporated herein by reference in its entirety.

What is claimed is:

1. An image formation apparatus comprising:

a belt-shaped photosensitive body;

an electric charger for charging the photosensitive body;

an exposure device for forming an electrostatic latent image on the photosensitive body;

a developing device for forming a visible image according to the electrostatic latent image;

a toner supply device for supplying to the developing device a toner used for forming the visible image;

an intermediate transfer roller for transferring the visible image from the photosensitive body onto a recording medium;

a fixing roller for fixing the visible image which has been transferred from the intermediate transfer roller onto the recording medium;

a claw member for assisting peeling off of the recording medium from the intermediate transfer roller; and a heating roller arranged so as to be in contact with a point on a non-toner side of the intermediate transfer roller, wherein the claw member is arranged so as to surround the heating roller and has a claw portion which is in contact with an outer circumference of the intermediate transfer roller in the vicinity of a contact point between the intermediate transfer roller and the recording medium.

2. An image formation apparatus as claimed in claim 1, wherein the heating roller is covered with a resin layer.

3. An image formation apparatus as claimed in claim 1, wherein the heating roller is covered with a fluorine resin layer.

4. An image formation apparatus comprising:

a photosensitive body of an endless belt shape;

an electric charger for charging the photosensitive body;

an exposure device for forming an electrostatic latent image on the photosensitive body;

a developing device for forming a visible image according to the electrostatic latent image;

a developing solution supply device for supplying to the developing device a developing solution used for forming the visible image;

an intermediate transfer roller for transferring the visible image from the photosensitive body onto a recording medium;

a fixing roller for fixing the visible image which has been transferred from the intermediate transfer roller onto the recording medium; and a transfer assisting roller having a built-in heat source and arranged in contact with the rear surface of the photosensitive body so as to press the surface of the photosensitive body against the intermediate transfer roller.

5. An image formation apparatus as claimed in claim 4, wherein the intermediate transfer roller has a built-in heat source.

6. An image formation apparatus as claimed in claim 4, wherein the transfer assisting roller is arranged in such a manner that the center of the transfer assisting roller is positioned on a line connecting the center of the fixing roller and the center of the intermediate transfer roller.

7. An image formation apparatus as claimed in claim 5, wherein the transfer assisting roller is arranged in such a manner that the center of the transfer assisting roller is positioned on a line connecting the center of the fixing roller and the center of the intermediate transfer roller.

8. An image formation apparatus comprising:

a photosensitive body of an endless belt shape;

an electric charger for charging the photosensitive body;

an exposure device for forming an electrostatic latent image on the photosensitive body;

a developing device for forming a visible image according to the electrostatic latent image;

a developing solution supply device for supplying to the developing device a developing solution used for forming the visible image;

an intermediate transfer roller having a built-in heat source for transferring the visible image from the photosensitive body onto a recording medium;

a fixing roller for fixing the visible image which has been transferred from the intermediate transfer roller onto the recording medium; and a transfer assisting roller having a built-in heat source and an outer circumference covered with a resin layer and arranged in contact with the rear surface of the photosensitive body so as to press the surface of the photosensitive body against the intermediate transfer roller and to compensate for heat loss from the intermediate transfer roller when the intermediate transfer roller transfers a visible image onto the recording medium.

9. An image formation apparatus as claimed in claim 8, wherein the resin layer is made from a film-shaped resin.

10. An image formation apparatus as claimed in claim 8, wherein the resin layer is made from a paint type resin.

11. An image formation apparatus as claimed in claim 8, wherein the transfer assisting roller is arranged in such a manner that the center of the transfer assisting roller is positioned on a line connecting the center of the fixing roller and the center of the intermediate transfer roller.

12. An image formation apparatus as claimed in claim 9, wherein the transfer assisting roller is arranged in such a manner that the center of the transfer assisting roller is positioned on a line connecting the center of the fixing roller and the center of the intermediate transfer roller.

13. An image formation apparatus as claimed in claim 10, wherein the transfer assisting roller is arranged in such a manner that the center of the transfer assisting roller is positioned on a line connecting the center of the fixing roller and the center of the intermediate transfer roller.

* * * * *